US008338761B2

(12) United States Patent
Nordh et al.

(10) Patent No.: US 8,338,761 B2
(45) Date of Patent: Dec. 25, 2012

(54) MICROWAVE HEATING DEVICE

(75) Inventors: Ulf Erik Nordh, Norrkoping (SE); Olle Niklasson, Finspong (SE); Fredrik Hallgren, Kolmarden (SE); Hakan K Carlsson, Norrkoping (SE)

(73) Assignee: Whirlpool Corporation, Benton Harbor, MI (US)

( * ) Notice: Subject to any disclaimer, the term of this patent is extended or adjusted under 35 U.S.C. 154(b) by 352 days.

(21) Appl. No.: 12/725,720

(22) Filed: Mar. 17, 2010

(65) Prior Publication Data

US 2010/0237067 A1 Sep. 23, 2010

(30) Foreign Application Priority Data

Mar. 20, 2009 (EP) ..... 09155733

(51) Int. Cl.
*H05B 6/70* (2006.01)

(52) U.S. Cl. ..... 219/690; 219/697

(58) Field of Classification Search ..... 219/690, 219/697

See application file for complete search history.

(56) References Cited

U.S. PATENT DOCUMENTS 4,776,918 A * 10/1988 Otsubo et al. ..... 156/345.41
5,134,965 A * 8/1992 Tokuda et al. ..... 118/723 MW
6,158,383 A * 12/2000 Watanabe et al. ..... 118/723 AN
2003/0106891 A1 6/2003 Fagrell et al.
2009/0295509 A1* 12/2009 Master et al. ..... 333/219.1

FOREIGN PATENT DOCUMENTS

EP 0478053 A1 4/1992

* cited by examiner

*Primary Examiner* — Phuc Dang

(74) *Attorney, Agent, or Firm* — Jason S. Burnette; Diederiks & Whitelaw PLC

(57) ABSTRACT

A microwave heating device comprises a cavity arranged to receive a load to be heated and a feeding structure for feeding microwaves in the cavity. The feeding structure comprises a transmission line for transmitting microwave energy generated by a microwave source and a resonator arranged at the junction between the transmission line and the cavity for operating as a feeding port of the cavity. The dielectric constant of the material constituting the interior of the resonator and the dimensions of the resonator are selected such that a resonance condition is established in the resonator for the microwaves generated by the source and impedance matching is established between the transmission line, the resonator and the cavity. In addition, the present invention provides a microwave heating device comprising a plurality of feeding ports with reduced crosstalk.

20 Claims, 8 Drawing Sheets

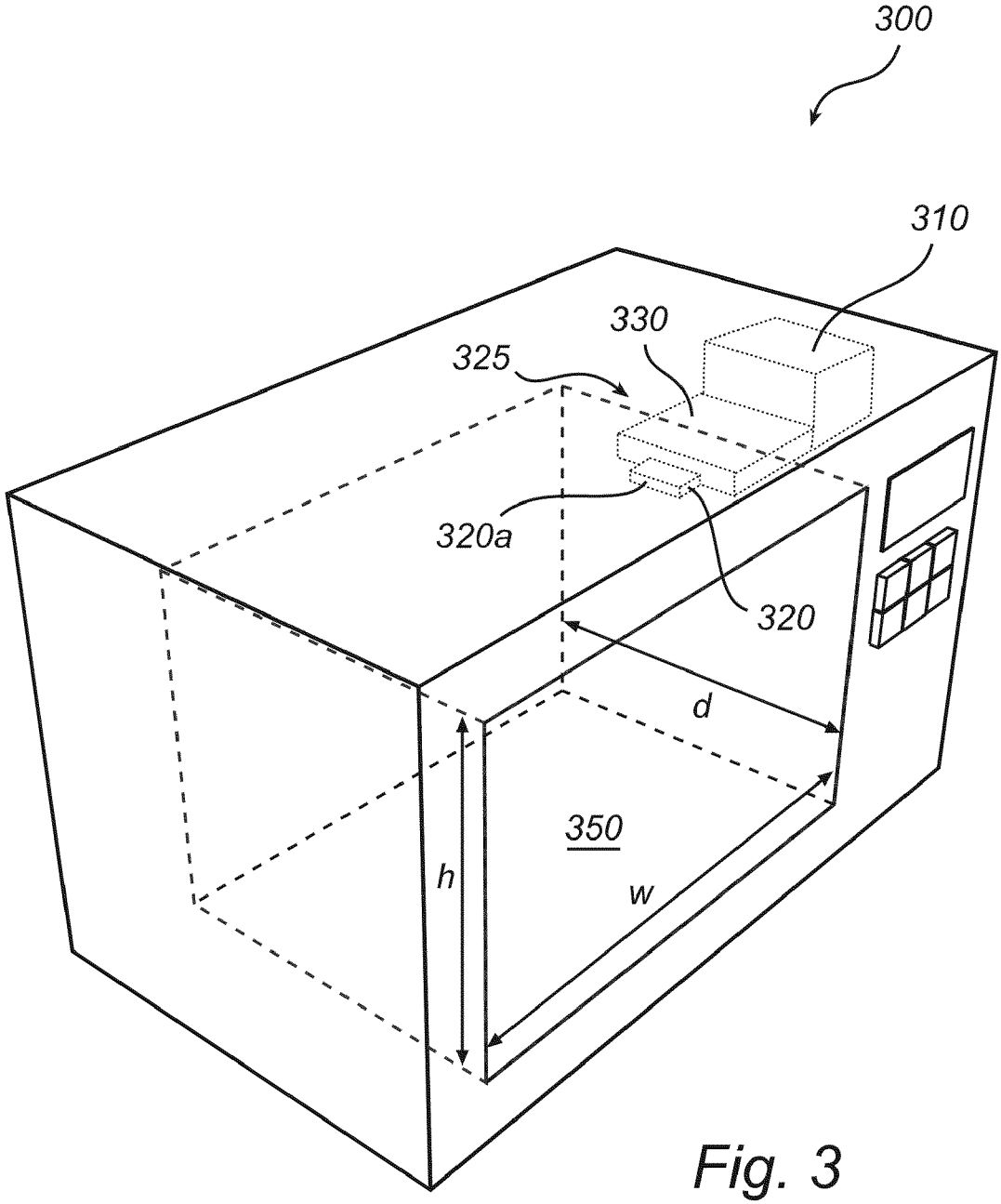
Fig. 3
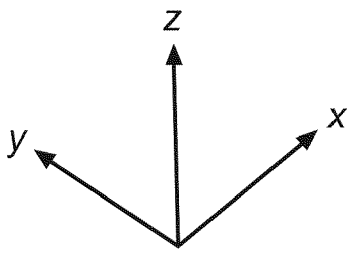

MICROWAVE HEATING DEVICE

BACKGROUND OF THE INVENTION

1. Field of the Invention

The present invention relates to the field of microwave heating. In particular, the present invention relates to a microwave heating device comprising a feeding structure enabling the device to operate in substance independently of the load to be heated.

2. Description of the Related Art

The art of microwave heating involves feeding of microwave energy into a cavity. When heating a load in the form of e.g. food by means of a microwave heating device, there are a number of aspects which have to be considered. Most of these aspects are well-known to those skilled in the art and include, for instance, the desire to obtain uniform heating of the food at the same time as a maximum amount of available microwave power is absorbed in the food to achieve a satisfactory degree of efficiency. In particular, the operation of the microwave heating device is preferably independent of, or at least very little sensitive to, the nature of the load to be heated.

In European patent EPO478053, a microwave heating device in the form of a microwave oven cavity being supplied with microwaves via an upper and a lower feed opening in a side wall of the oven cavity is disclosed. The supply is made via a resonant waveguide device having a Q-value which is higher than the Q-value/s of the loaded cavity. The waveguide is so dimensioned that a resonance condition is established in the waveguide device. The resonance condition gives a phase lock of the microwaves at the respective feed openings, where the phase lock preferably is in synchronism with the desired cavity mode/s.

SUMMARY OF THE INVENTION

The present invention provides a microwave heating device with reduced dependency on the nature of the load to be heated and/or to alleviate limitations in terms of flexibility with regard to the feeding of the microwaves.

According to an aspect of the present invention, a microwave heating device is provided. The microwave heating device comprises a cavity arranged to receive a load to be heated and a feeding structure for feeding microwaves into the cavity. The feeding structure comprises a transmission line for transmitting microwave energy generated by a microwave source and a resonator arranged at the junction between the transmission line and the cavity for operating as a feeding port of the cavity. The dielectric constant of the material constituting the interior of the resonator and the dimensions of the resonator are selected such that a resonance condition is established in the resonator for the microwaves generated by the source and impedance matching is established between the transmission line, the resonator and the cavity.

A resonator may be arranged at the junction between the transmission line and the cavity for operating as a feeding port in order to achieve a stable field pattern in the cavity. Advantageously, an adequate and stable matching is also provided. The dielectric constant of the material constituting the interior of the resonator and the dimensions of the resonator are selected such that a resonance condition is established in the resonator for the microwaves generated by the source and impedance matching is established between the transmission line, the resonator and the cavity. In this way, a resonator having a high Q-value, in particular higher than the Q-value/s of a loaded cavity, is provided at the junction between the transmission line and the cavity. The present invention provides a microwave heating device which is in substance independent of, or at least very little sensitive to, the load (or nature of the load) arranged in the cavity. In particular, the microwave heating device is very little sensitive to load variation.

Further, as compared to e.g. a cavity fed via a regularly sized aperture without any resonator (i.e., an air-filled waveguide connected to the cavity), the present invention provides a more stable heating device is provided. The heating device may be operated at a stable frequency in substance independently of (or at least less dependent of) the load arranged in the cavity.

Further, because of transmitting properties, the use of a resonator facilitates the impedance matching between the transmission line and the cavity.

The present invention further provides a microwave heating device having a feeding aperture (or feeding port) of smaller dimensions than conventional feeding apertures, thereby resulting in feeding of a "cleaner" mode, i.e. preferably a single mode, in the cavity. For example, the present invention enables the reduction of the feeding aperture from the standard size of minimum 61 mm (the normal size being approximately 80-90 mm) to about 6-20 mm.

Further, to ensure feeding of a single mode in the cavity, as the design of the resonator determines its transmitting properties, the cavity may be designed in accordance with the design of the resonator to support a mode corresponding to the frequency at which the microwaves are fed into the cavity.

According to an embodiment, the material constituting the interior of the resonator has a dielectric constant greater than that of the material constituting the interior of the transmission line and the cross-sectional dimension of the resonator is selected such that it is smaller than that of the transmission line. As will be illustrated in more detail in the following, the size of the resonator, i.e. the size of the feeding port, is scaled down with the square root of the dielectric constant ($\sqrt{\in}$) of the material constituting the interior of the resonator.

For example, the dielectric material constituting the interior of the resonator may be a ceramic, such as e.g. aluminum dioxide ($Al_2O_3$), titanium dioxide ($TiO_2$) and different titanates e.g. magnesium titanate ($MgTiO_3$) and calcium titanate ($CaTiO_3$). Advantageously, the dielectric constant ($\in$) is comprised in the range of 3-150 and is preferably higher than 10.

Optionally, the resonator may be coated with a metal, which is particularly advantageous if the constant of the dielectric material is relatively low, for instance in the order of 10, for avoiding, or at least reducing, microwave leakage from the resonator. However, if the dielectric constant is relatively high, for instance in the order of 80-90 (such as for example $TiO_2$), a metal coating is not necessary.

According to another embodiment, the microwave source is a solid-state microwave generator comprising semiconductor elements. The advantages of a solid-state microwave generator comprise the possibility of controlling the frequency of the generated microwaves, controlling the output power of the generator and an inherent narrow-band spectrum.

It will be appreciated that the transmission line may be a standard one such as, e.g., a waveguide, a coaxial cable or a strip line.

The resonator is an elongated piece of dielectric material having the same type of cross-sectional shape as that of the transmission line. For example, the resonator and the transmission line may have a cylindrical or rectangular cross-section. However, the resonator typically has smaller dimensions.

According to an embodiment, the microwave heating device may further comprise at least one additional feeding structure and microwave source, such as any of the feeding structures and microwave sources defined above, for feeding microwaves in the cavity via an additional resonator. In addition to the microwave heating device having low sensitivity to the nature of the load, this embodiment provides a cavity fed from two apertures (or feeding ports) with a reduced crosstalk compared to other microwave heating devices.

The microwave sources are respectively operated at different frequencies. In the case of a microwave heating device comprising two feeding structures, the cavity of the microwave heating device is excited with two different frequencies via two feeding ports, respectively. Operating the microwaves sources at different frequencies is particularly advantageous for reducing crosstalk. For example, in the case of a cavity comprising, e.g., two feeding structures, a first feeding structure comprises a first resonator configured to transmit microwaves at a well-defined first frequency F1 while the second feeding structure comprises a second resonator configured to transmit microwaves at a well-defined second frequency F2. The second resonator is somewhat configured to block, or at least strongly limit, the transmission through itself of the microwaves fed into the cavity from the first feeding port. This reduces significantly crosstalk between the two feeding ports. In addition, it will also in substance prevent transmission of unwanted frequencies, harmonics and sub-harmonics, i.e. electromagnetic compatibility (EMC).

Although the above example is described with a cavity comprising two feeding structures or resonators, it will be understood that the same principle applies for, and the same advantage with respect to the reduction of cross-talk may be obtained with, a cavity comprising more than two feeding structures.

In the case of a microwave heating device comprising two feeding ports, the feeding ports may be orthogonally arranged at the walls of the cavity. Particularly if the microwaves transmitted from the two feeding ports have the same frequency. In general, for more than one feeding structure, the location of the feeding ports at the walls of the cavity may be optimized to achieve a uniform heating pattern.

Further objectives of, features of, and advantages with, the present invention will become apparent when studying the following detailed disclosure, the drawings and the appended claims. Those skilled in the art realize that different features of the present invention can be combined to create embodiments other than those described in the following.

BRIEF DESCRIPTION OF THE DRAWINGS

The above, as well as additional objects, features and advantages of the present invention, will be better understood through the following illustrative and non-limiting detailed description of preferred embodiments of the present invention, with reference to the appended drawings, in which:

FIG. 3 schematically shows a microwave heating device according to an embodiment of the present invention;

All the figures are schematic, not necessarily to scale, and generally only show parts which are necessary in order to elucidate the invention, wherein other parts may be omitted or merely suggested.

DETAILED DESCRIPTION OF THE PREFERRED EMBODIMENTS

Figure 1:
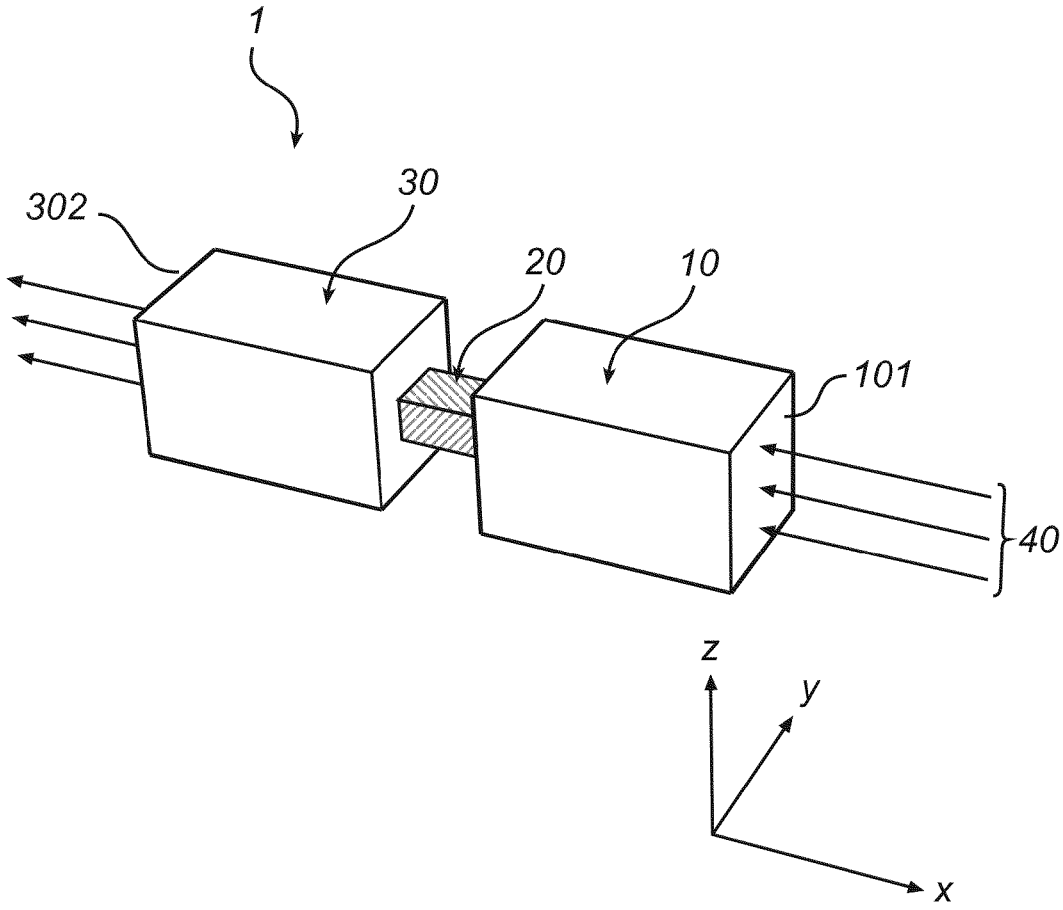
FIG. 1 schematically shows a waveguide structure comprising two air-filled waveguides connected via a resonator for illustrating the concept of the present invention.

As an introduction to the concept of the present invention, FIG. 1 shows a waveguide structure comprising two air-filled waveguides connected to each other via a resonator (or resonant waveguide).

FIG. 1 shows a waveguide structure 1 comprising a first air-filled transmission line or waveguide 10, a resonator or resonant waveguide 20 and a second air-filled transmission line or waveguide 30. Microwaves 40 are fed into the structure 1 at a first end or face 101 of the first air-filled waveguide 10. The microwaves propagate along the first transmission line 10 and the second transmission line 30 via the resonant waveguide 20 which is arranged at the junction between the first and the second transmission lines 10 and 30. The microwaves exit the waveguide structure 1 at the end 302 of the second transmission line 30, which end 302 is the end opposite to the end of the transmission line 30 being adjacent to the resonant waveguide 20.

Using the coordinate system (x, y, z) represented in FIG. 1, the direction of propagation of the microwaves is along the x-axis, which is also the axis used to define the lengths of the elements of the waveguide structure 1 in the following. The widths of the elements of the waveguide structure are defined with respect to the y-axis and the heights are defined with respect to the z-axis.

In the structure 1 described with reference to FIG. 1, the two air-filled waveguides 10 and 30 have equal (or at least almost equal) cross-section (y, z) in the direction of propagation. The resonator 20 couples the microwaves transmitted along the first transmission line 10 to the second transmission line 30.

As an example, the resonant waveguide 20 is assumed to be a waveguide filled with Aluminum Oxide, $Al_2O_3$, whose dielectric constant ($\in$) is assumed to be equal to 9. The resonant waveguide or ceramic-filled waveguide 20 is further assumed to be coated with metal in order to avoid, or at least minimize, microwave leakage. It is noted that if the dielectric constant was significantly higher, it would not be necessary to assume the presence of a metal coating as the energy leakage would be strongly evanescent.

The dimensions of the waveguide 20 are chosen to provide resonance conditions, i.e. to form a resonator 20. For minimizing reflection at the junction between the two air-filled transmission lines, the impedances need to be matched (i.e., sufficiently close). The equation for the characteristic impedance $Z_0$ for a propagating mode in a waveguide is expressed as:

$$Z_0 = \frac{\eta}{\sqrt{1-\left(\frac{f_c}{f}\right)^2}} \quad \text{Equation 1}$$

where $\eta$ is the impedance for free space (equal to 120 $\pi$), $f_c$ is the cut-off frequency for the propagating mode in the waveguide, f is the frequency of operation and f is larger than fc ($f>f_c$) if the mode propagates.

In view of equation 1, it is preferred to accomplish the same, or at least almost the same, cut-off frequencies in all three waveguides, thereby providing a junction with very low reflection. For obtaining the same cut-off frequencies, the width of the resonant waveguide needs to be scaled with the square root of its dielectric constant $\sqrt{\in}$ in comparison with the width of the air-filled waveguide. In the present example, assuming an air-filled waveguide having a width of 80 mm, the width of the resonant waveguide (or resonant body) is equal to approximately 26.67 mm $$\left(i.e., \frac{80}{\sqrt{9}}\right)$$

when $Al_2O_3$ ($\in$=9) is used as the dielectric material inside the resonator.

In the present example, where both ends of the structure 1 are open, the length of the resonant waveguide cannot be directly selected to be a whole number of half-wavelength to accomplish resonance (at a specific frequency) in the resonant waveguide 20. Instead, e.g. in the case of the $TE_{102}$ mode, the length needs to be larger than one wavelength. This is the necessary condition to have resonance in a resonator completely enclosed by metal. The length of the resonator is, in this case for the $TE_{102}$ mode, selected to be 38.5 mm and the height is arbitrarily selected to be 10 mm, thereby resulting in a resonance close to the center of the ISM band 2.4-2.5 GHz.

Figure 2:
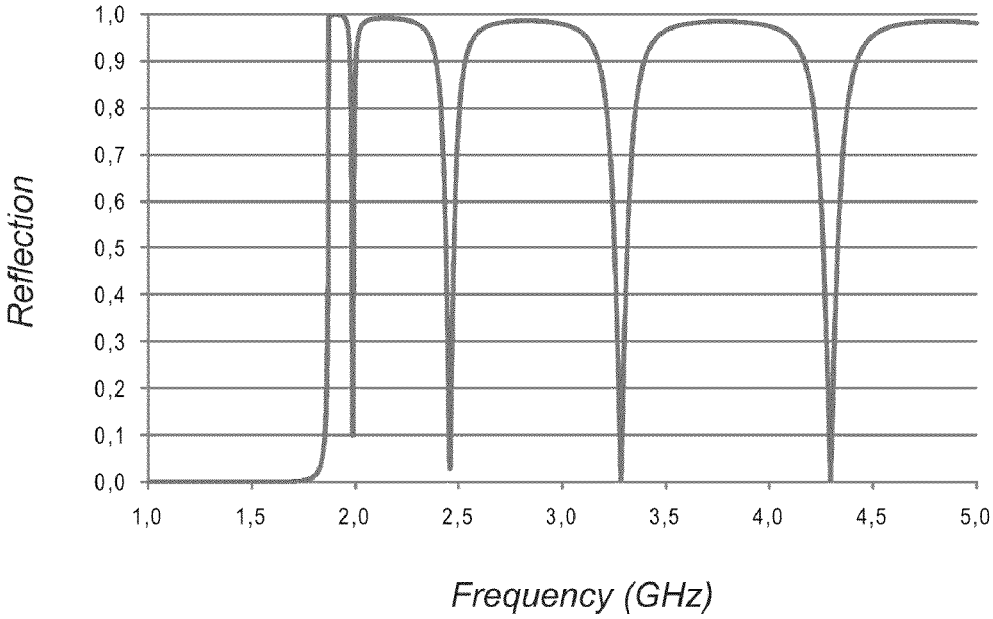
FIG. 2 shows the reflection characteristic for the waveguide structure described with reference to FIG. 1.

FIG. 2 shows the reflection characteristic in the waveguide structure 1 described with reference to FIG. 1. FIG. 2 illustrates that a good matching is obtained for the $TE_{102}$ mode at 2456 MHz, where the reflection factor is approximately equal to 0.0284 (i.e., 2.84%). FIG. 2 illustrates also that the propagation cut-off is at approximately 1870 MHz for the waveguide structure 1 and that the ceramic-filled resonator 20 will only allow transmission for frequencies which are very close to its resonance frequencies (taking the end surface leakage into account). As can be seen in FIG. 2, the Q factor is different for the different resonances and, in particular, decreases if the resonance frequency increases. Depending on the application and the demand for narrow transmission bandwidth, it is possible to select different resonances by using different lengths for the resonant waveguides. A shorter resonant waveguide compared to the wavelength provides a higher Q-value ($TE_{101}$ mode), which is preferred if a narrower transmission bandwidth is needed.

The above example illustrates the concept of the present invention using a waveguide structure 1 comprising two air-filled transmission lines and a resonant waveguide. In the microwave heating device of the present invention, the second transmission line corresponds to a cavity, and the first transmission line and the resonant waveguide correspond to the feeding structure for feeding microwaves into the cavity.

With reference to FIG. 3, there is shown a microwave heating device 300, for instance a microwave oven, having features and functions according to an embodiment of the present invention.

The microwave oven 300 comprises a cavity 350 defined by an enclosing surface. One of the side walls of the cavity 350 may be equipped with a door (not shown) for enabling the introduction of a load, e.g. a food item, in the cavity 350.

The microwave oven 300 comprises a feeding structure 325 for feeding microwaves into the cavity 350 via a single feeding aperture 320*a*. The feeding structure comprises a transmission line 330 for transmitting microwave energy generated by a microwave source 310. The feeding structure further comprises a resonator 320 arranged at the junction between the transmission line 330 and the cavity 350 for operating as a single feeding port 320*a* of the cavity.

Although the microwave oven 300 described with reference to FIG. 3 has a rectangular enclosing surface, it will be appreciated that the cavity of the microwave oven is not limited to such a shape and may, for instance, have a circular cross section, or any geometry describable in a general orthogonal curve-linear coordinate system. In general, the cavity 350 is made of metal. The transmission line 330 may for instance be a coaxial cable.

The microwave oven 300 further comprises a microwave source 310 connected to the feeding port 320*a* of the cavity 350 by means of the transmission line or waveguide 330 and the resonator 320.

Although the resonator 320 is considered to constitute the feeding port of the cavity, it is understood that the face or end 320*a* of the resonator body 320 adjacent to the wall of the cavity corresponds to the feeding port. In the following, when referring to the feeding port, reference will be made to either the face 320*a* of the resonator 320 or the resonator 320, interchangeably.

According to an embodiment, the resonator is an elongated piece of dielectric material, extending along the direction of propagation (axis x), and preferably having the same type of cross-sectional shape as the transmission line 330 (e.g. rectangular, circular, etc.).

The dielectric constant of the material constituting the interior of the resonator 320 and the dimensions of the resonator 320 are selected such that a resonance condition is established in the resonator 320 for the microwaves generated by the source 310 and impedance matching is established between the transmission line 330, the resonator 320 and the cavity 350 in accordance with, e.g., the design rules described with reference to FIG. 1.

In particular, referring to FIG. 3, the resonator 320 has a dielectric constant greater than that of the material constituting the interior of the transmission line 330 and the cross-sectional dimension of the resonator is selected such that it is smaller than that of the transmission line. In particular, the size (e.g. the width) of the resonator is scaled down with $\sqrt{\in}$.

Further, the microwave oven may comprise a switch (not shown) associated with the feeding port 320 and arranged in the transmission line 330 for stopping the feeding from the feeding port 320.

According to an embodiment, the resonator is advantageously designed to be full-wave resonant, i.e. resonant for one wavelength, thereby giving a mode index of 2 in the length dimension (i.e. along the x-direction).

According to an embodiment, the microwave source 310 is a solid-state based microwave generator comprising, for instance, silicon carbide (SiC) or gallium nitride (GaN) components. Other semiconductor components may also be adapted to constitute the microwave source 310. In addition to the possibility of controlling the frequency of the generated microwaves, the advantages of a solid-state based microwave generator comprise the possibility of controlling the output power level of the generator and an inherent narrow-band feature. The frequencies of the microwaves that are emitted from a solid-state based generator usually constitute a narrow range of frequencies such as 2.4 to 2.5 GHz. However, the present invention is not limited to such a range of frequencies and the solid-state based microwave source 310 could be adapted to emit in a range centered at 915 MHz, for instance 875-955 MHz, or any other suitable range of frequency (or bandwidth). The present invention is for instance applicable for standard sources having mid-band frequencies of 915 MHz, 2450 MHz, 5800 MHz and 22.125 GHz. Alternatively, the microwave source 310 may be a frequency-controllable magnetron such as that disclosed in document GB2425415.

Figure 5:
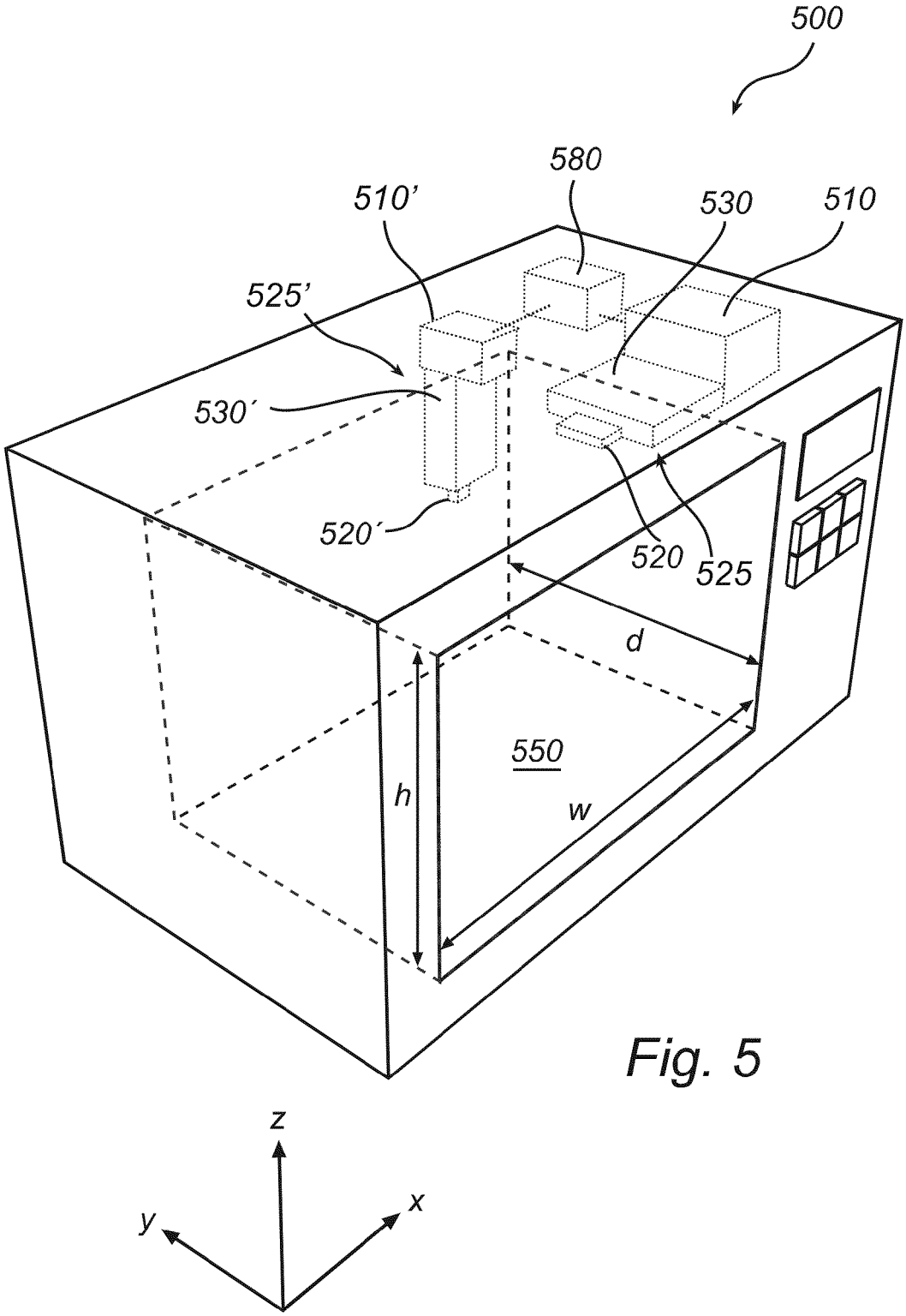
FIG. 5 schematically shows a microwave heating device according to another embodiment of the present invention.
Figure 8:
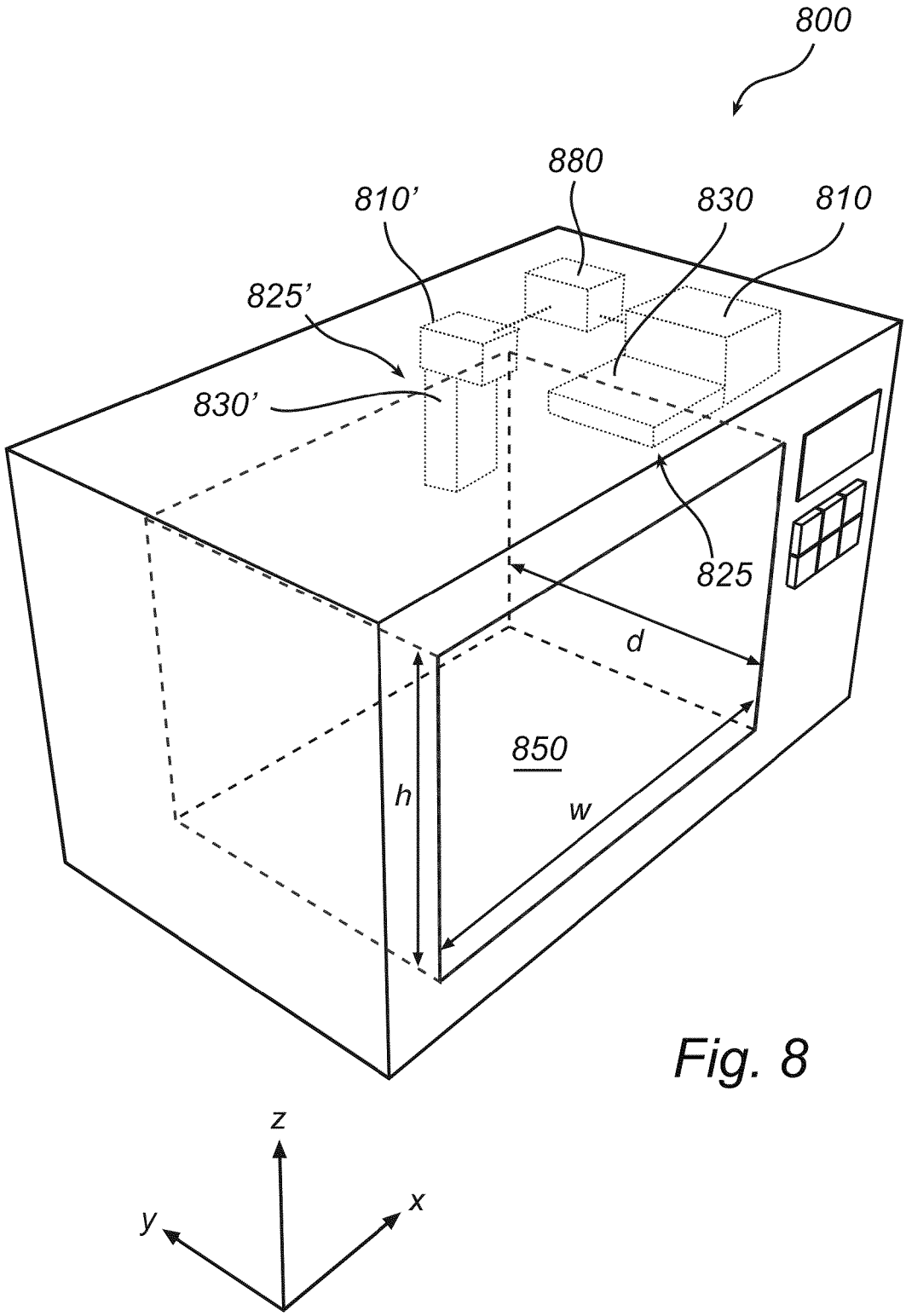
FIG. 8 schematically shows a microwave heating device comprising a standard feeding structure with air-filled waveguides and without resonators.

In general, the number and/or type of available mode fields in a cavity are determined by the design of the cavity. The design of the cavity comprises the physical dimensions of the cavity and the location of the feeding port in the cavity. The dimensions of the cavity are generally denoted by the reference signs h, d and w for the height, depth and width, respectively, in FIGS. 3, 5 and 8 provided with a coordinate system (x, y, z), such as shown in FIG. 3.

Referring to the design rules described with reference to FIG. 1, for designing the cavity 350 of the microwave heating device 300, the impedance mismatch created when the second air-filled waveguide of FIG. 1 is replaced with the cavity 350, i.e. the difference in impedance seen from the resonator 320, is preferably taken into account. For this purpose, the length of the resonator 320 is slightly adjusted and the dimensions of the cavity are tuned. During the tuning procedure, a load simulating a typical load to be arranged in the cavity is preferably present in the cavity.

In addition, the tuning may be accomplished via local impedance adjustments, e.g., by introduction of a tuning element (such as a capacitive post) arranged in the transmission line or in the cavity, adjacent to the resonator.

In the present example, the cavity is designed to have a width of 232 mm, a depth of 232 mm and a height of 111 mm. The feeding port 320 may be arranged at, in principle, any walls of the cavity. However, there is generally an optimized location of the feeding port for a predefined mode. In the present example, the feeding port 320*a* is located in the upper part of a side wall of the cavity, on the right hand-side in the cavity 300 shown in FIG. 3 (x=w). The feeding port 320*a* is placed at half-depth (y=d/2) and at almost full height (z=h).

Figure 4:
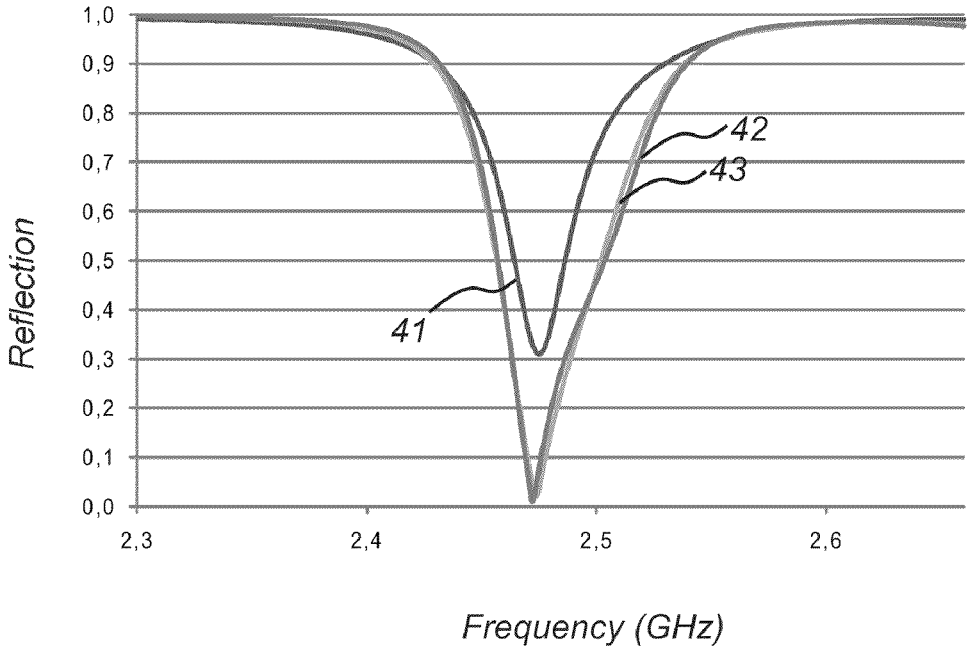
FIG. 4 shows reflection characteristics for the heating device described with reference to FIG. 3.

With reference to FIG. 4, results of simulation tests performed in a cavity having the above design for three different dielectric loads, namely a piece of frozen minced meat having a typical dielectric constant $\in$=4−j2 (curve denoted 41), a piece of thawed minced meat having a typical dielectric constant $\in$=52−j20 (curve denoted 42) and some liquid pancake batter having a typical dielectric constant $\in$=36−j15 (curve denoted 43) are described. FIG. 4 shows a graph of the signals reflected from the cavity as a function of the frequency obtained by numerical investigation for the three different loads (curves 41-43). FIG. 4 shows that the resonance frequency, which is about 2454 MHz, is very little dependent of the load dielectric constant, i.e. almost independent of the nature of the load. Thus, the microwave heating device 300 of the present invention is particularly advantageous in that its frequency of operation is very stable. In addition, it is noted that the reflection factors are comparatively unaffected (0.311 for $\in$=4−j2, 0.0090 for $\in$=52−j20 and 0.0203 for $\in$=36−j15). A similar test performed with conventional microwave ovens having regularly sized apertures would show a significantly larger variation in both matching frequency and reflection factors.

For local impedance adjustment, the microwave heating device 300 may further comprise a tuning element (not shown) arranged in the transmission line 330 or in the cavity 350, adjacent to the resonator 320.

With reference to FIG. 5, there is shown a microwave heating device 500, for instance a microwave oven, having features and functions according to another embodiment of the present invention.

The microwave heating device 500 is similar to the microwave heating device 300 described with reference to FIG. 3 but further comprises at least one additional feeding structure 525' and microwave source 510', such as the feeding structure 325 and microwave source 310 described in the above with reference to FIG. 3. The additional feeding structure 525' comprises a (additional or second) transmission line 530' for transmitting microwave radiation generated by the additional microwave source 510'. The feeding structure further comprises a (additional or second) resonator 520' arranged at the junction between the (additional) transmission line 530' and the cavity 550 for operating as an additional feeding port of the cavity.

In such a configuration, microwaves at a first frequency can be fed into the cavity 550 using the first feeding port or resonator 520 while microwaves at a second frequency can be fed into the cavity 550 using the second feeding port or resonator 520'.

It will be appreciated that the additional feeding structure 525' and additional microwave source 510' may be characterized in a similar manner as, and/or may comprise the same further features as, the feeding structure 325 and microwave source 310 described in the above with reference to FIG. 3. In other words, the variants of the feeding structure 325 and microwave source 310 described in appended claims 2-9 may also apply for the additional feeding structure 525' and the additional microwave source 510'.

Referring to FIG. 1, for designing a double fed cavity of a microwave heating device operating at two different frequencies, the impedance mismatch created when the second air-filled waveguide of FIG. 1 is replaced with the cavity, i.e. the difference in impedance seen from the resonators, is preferably taken into account. For this purpose, the length of the resonator is adjusted and the dimensions of the cavity are tuned. During the tuning procedure, a load simulating a typical load to be arranged in the cavity is preferably present in the cavity. In addition, the tuning may be accomplished via local impedance adjustments, e.g., by introduction of a tuning element such as e.g. a capacitive post adjacent to the resonators.

In the present example, the cavity is designed to have a width of 261 mm, a depth of 340 mm and a height of 170 mm. The second feeding port 520' is arranged at the center of the ceiling wall of the cavity (x=w/2; y=d/2; z=h). The resonant dielectric bodies 520 and 520' are made of $Al_2O_3$ (c=9) and have substantially equal width and height, 26.67 mm and 10 mm, respectively. However, the length of the resonator differs, wherein the first resonator 520 has a length of 40.5 mm while the second resonator 520' has a length of 38.0 mm.

The microwave heating device 500 is advantageous in that it comprises a double fed cavity 550 in which crosstalk between the two feeding ports is reduced as compared to a conventional double fed cavity. The lowering of the crosstalk obtained with the use of ceramic resonators as compared to the use of regularly-sized, air-filled waveguides will now be illustrated with reference to FIGS. 6-12.

Figure 6:
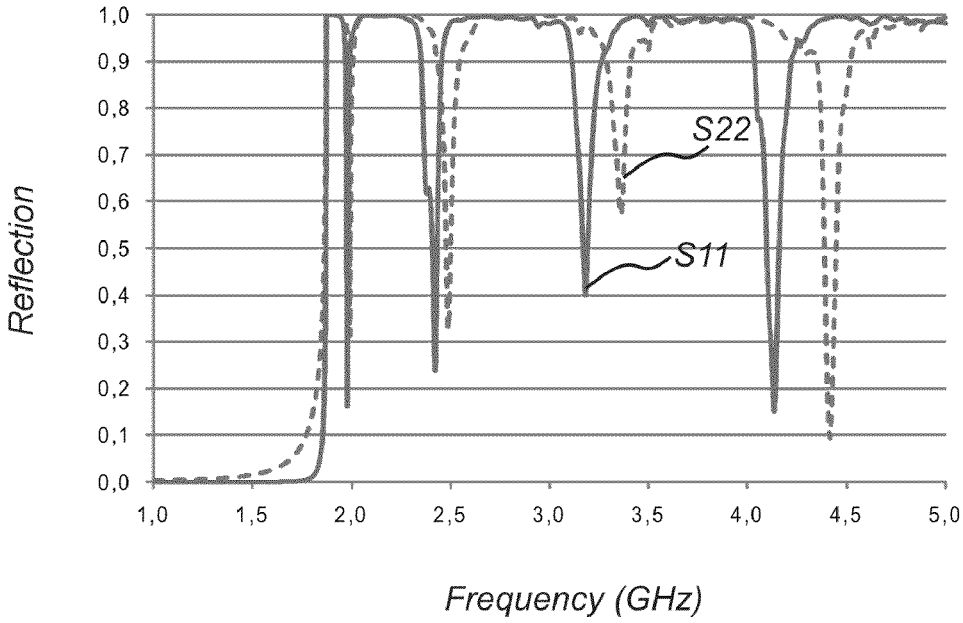
FIG. 6 shows the reflection characteristics for the heating device with two feeding ports described with reference to FIG. 5.
Figure 7:
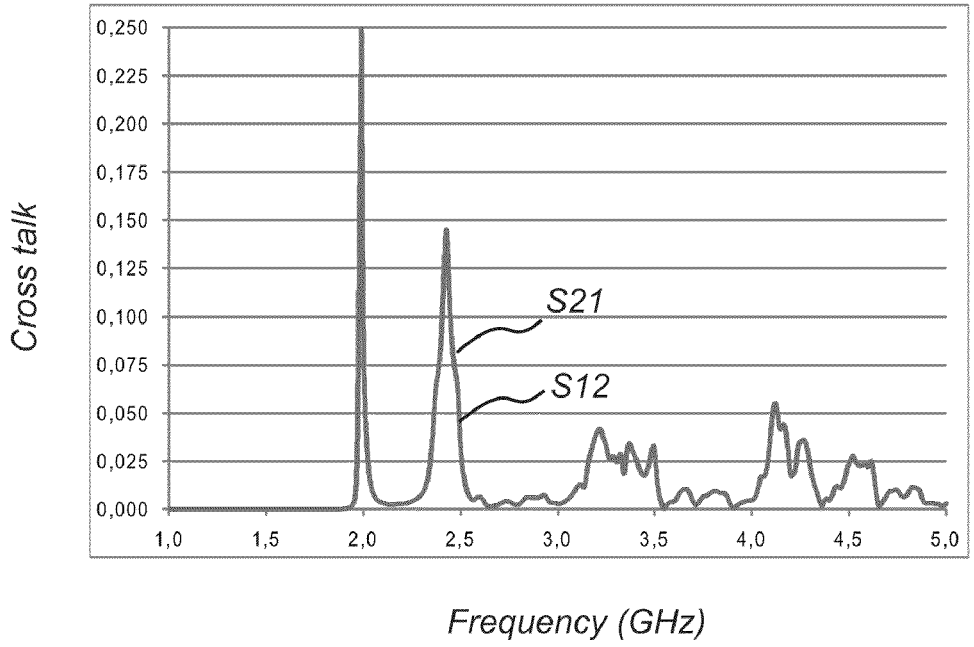
FIG. 7 shows the crosstalk characteristics for the two feeding ports of the heating device described with reference to FIG. 5.

FIGS. 6 and 7 show results of simulation tests performed in a cavity having the above design and dimensions with a load having a dielectric constant $\in$=4−j2 (piece of frozen minced meat). The cavity 550 is considered to be an empty air-filled cavity with a rectangular geometry having a width of 261 mm, a depth of 340 mm and a height of 170 mm. The cavity presents resonances at 2422 MHz and 2490 MHz inside the ISM band.

FIG. 6 illustrates a graph of the signal reflected from the cavity 550 as a function of the frequency obtained by numerical investigation of the feeding structure and cavity described with reference to FIG. 5. FIG. 6 shows that a rather good match is obtained at 2422 MHz where the curve denoted has a value of 0.237 and at 2490 MHz where the curve denoted S22 has a value of 0.327. The curve denoted S11 corresponds to the power going from the first generator 510 (associated with the first feeding structure 525) and returning to the first feeding port 520 (or in the first resonator) while the curve denoted S22 corresponds to the power going from the second generator 510' (associated with the second feeding structure 525') and returning to the second feeding port 520' (or in the second resonator).

FIG. 7 illustrates the crosstalk for the cavity 550 described with reference to FIG. 5. The graph shows the curve S12 corresponding to the power detected at the first feeding port 520 when the second generator 510' is ON and the first generator 510 is OFF and the curve S21 corresponding to the power detected at the second feeding port 520' (or in the second resonator) when the first generator 510 is ON and the second generator 510' is OFF. FIG. 7 shows that S12 has a value of 0.141 at 2422 MHz and S21 has a value of 0.054 at 2490 MHz (in FIG. 7, although the two curves are close and seem to be superposed, the values of S21 and S12 are different).

The definition of the curves S11, S12, S21 and S22 given above will be the same in the following.

A simulation was performed for a microwave heating device 800 identical to the microwave heating device 500 described with reference to FIG. 5 except that the two resonators 520 and 520' were removed, as shown in FIG. 8. Instead, the feeding ports were standard feeding ports where the two air-filled waveguides 830 and 830' emanate at the cavity wall and ceiling, respectively.

As the resonators were removed, an adjustment of the impedance in the feeding structure (junction between the transmission lines 830 and 830' and the cavity 850) was realized to obtain a similar impedance matching as the matching obtained for the microwave heating device 500 described with reference to FIG. 5. The cavity 850 had the same dimensions as the cavity 550 described with reference to FIG. 5, namely a width of 261 mm, a depth of 340 mm and a height of 170 mm. The load arranged in the cavity was a piece of frozen minced meat with a dielectric constant $\in$=4−j2. The feeding ports had the same cross sectional size as the waveguide cross-section, i.e. 80×20 mm. The results of the simulation are presented in FIGS. 9 and 10.

Figure 9:
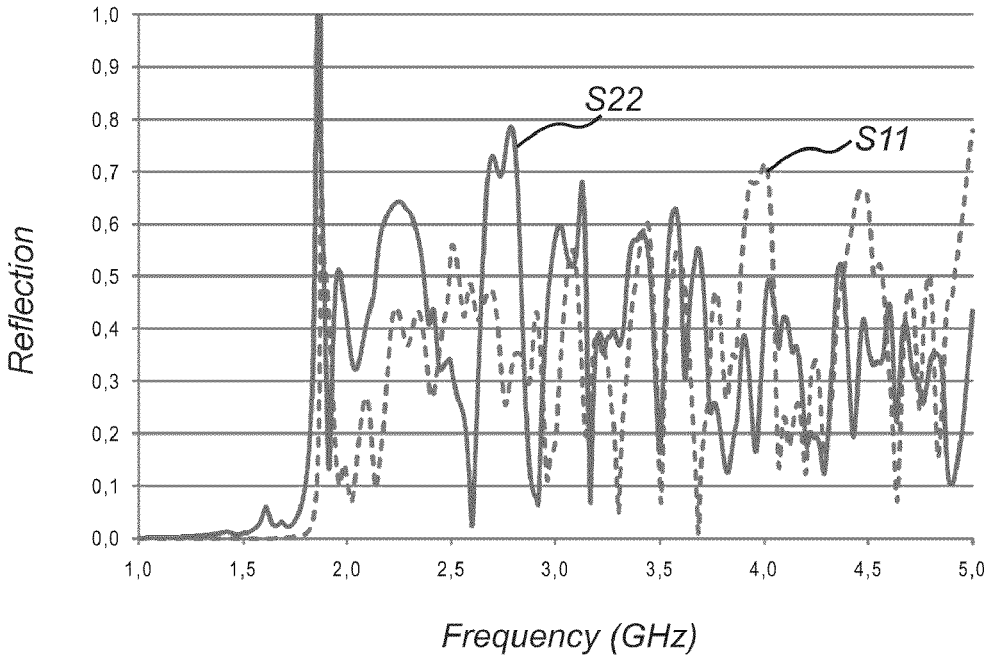
FIG. 9 shows the reflection characteristics for the heating device described with reference to FIG. 8.

FIG. 9 shows a graph of the signals reflected from the cavity as a function of the frequency obtained by numerical investigation. FIG. 9 shows that a rather good match is obtained at 2422 MHz where the curve denoted S11 has a value of 0.291 and at 2490 MHz where the curve denoted S22 has a value of 0.321

Figure 10:
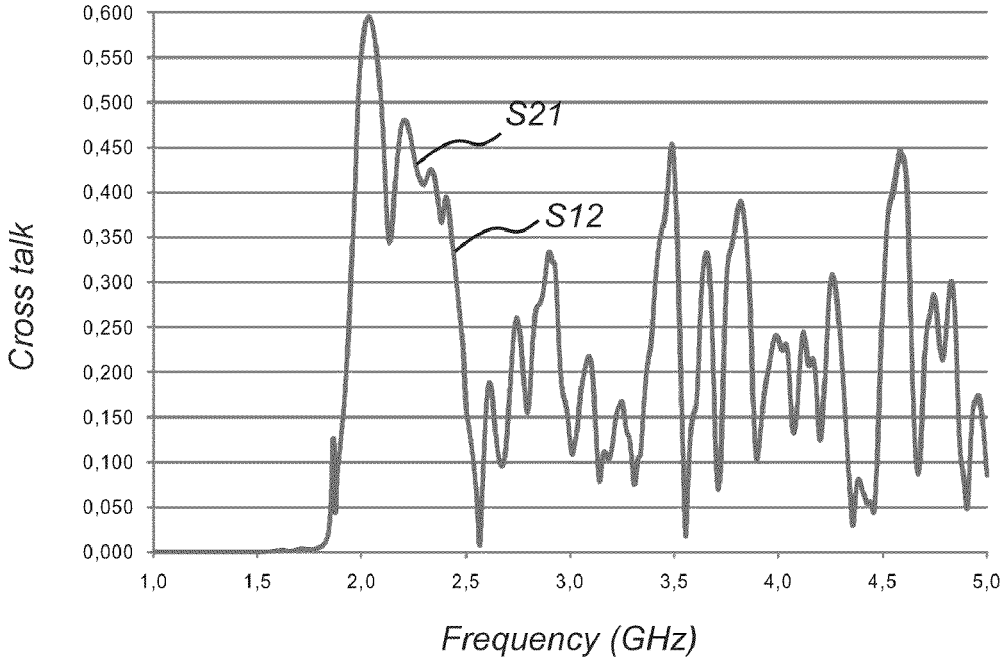
FIG. 10 shows the crosstalk characteristics for the two feeding ports of the heating device described with reference to FIG. 8.

FIG. 10 illustrates the crosstalk where the curve S12 has a value of 0.326 at 2422 MHz and S21 has a value of 0.205 at 2490 MHz.

Thus, even with a similar impedance matching as the standard microwave heating device 800 using regularly sized, air-filled feeding ports such as described with reference to FIG. 8, the microwave heating device 500 described with reference to FIG. 5 enables a significant reduction of the crosstalk between the two feeding ports of a double fed cavity.

Figure 11:
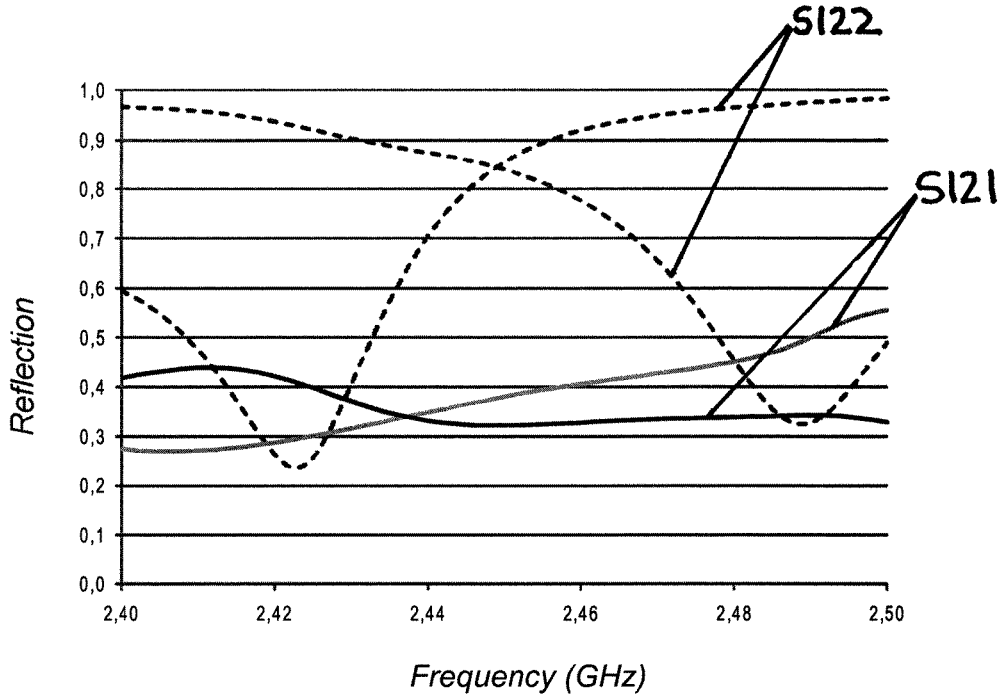
FIG. 11 shows an ISM (industrial scientific and medical) band (2.4-2.5 GHz) comparison of the reflection characteristics shown in FIGS. 6 and 9.

FIG. 11 shows an ISM (industrial scientific and medical) band (2.4-2.5 GHz) comparison of the curves denoted S11 and S22 in FIGS. 6 and 9 where the solid lines S121 represent the frequency response for the microwave heating device 800 comprising only air-filled waveguides (and no resonators) and the broken lines S122 represent the frequency response for the microwave heating device 500 comprising feeding structures with resonators. FIG. 11 illustrates that a slightly better matching is obtained at 2422 MHz and 2490 MHz for the microwave heating device 500 comprising feeding structures with resonators. Instead, the microwave heating device 800 comprising two air-filled waveguides without resonators result in a broadband matching.

Figure 12:
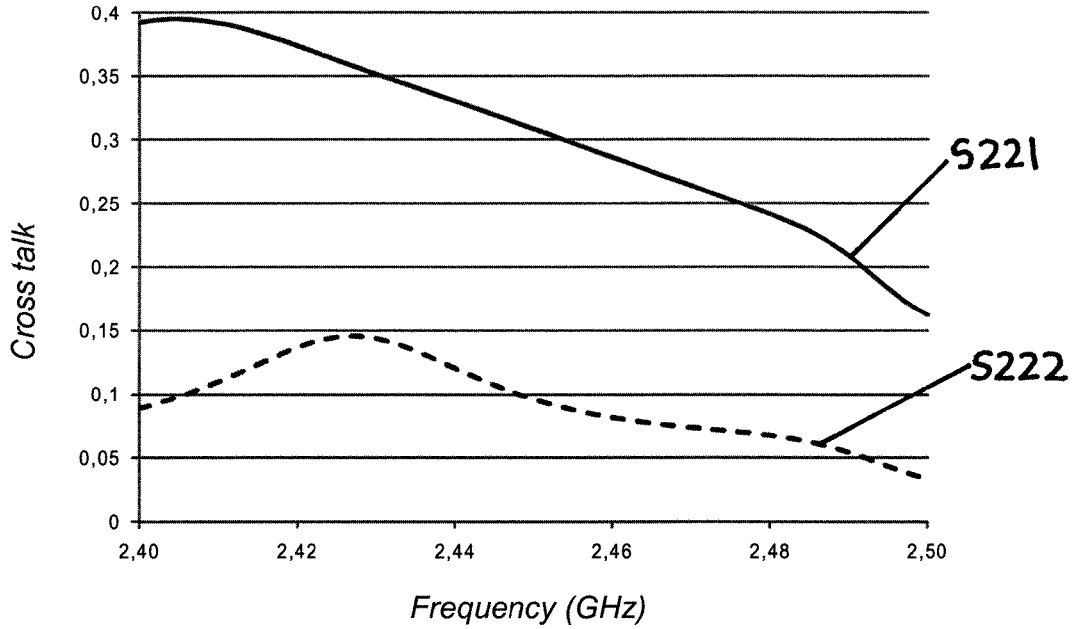
FIG. 12 shows an ISM band (2.4-2.5 GHz) comparison of the crosstalk characteristics shown in FIGS. 7 and 10.

FIG. 12 shows an ISM band (2.4-2.5 GHz) comparison of the crosstalk level for the curves presented in FIGS. 7 and 10 where the solid line S221 represents the crosstalk level for the microwave heating device 800 comprising only air-filled waveguides (and no resonators) and the broken line S222 represents the crosstalk level for the microwave heating device 500 comprising feeding structures with resonators. FIG. 12 illustrates that a lower crosstalk is obtained for a microwave heating device 500 comprising feeding structures with resonators.

In addition to the reduction of crosstalk, the double feeding at different frequencies of the cavity of the microwave device is advantageous in that it enables a number of possible regulations of the microwave heating device and, in particular, optimization of the heating pattern in the cavity. For example, still in the case of a cavity with two feeding ports, the two resonators may be configured to excite modes resulting in complementary heating patterns in the cavity, thereby providing uniform heating in the cavity. If the first resonator is configured to transmit microwaves at a first frequency resulting in a first heating pattern (or first mode) with hot and cold spots at specific locations in the cavity, the second resonator may be configured to transmit microwaves at a second frequency such that the presence of hot and cold spots in the first heating pattern is compensated by the second heating pattern (or second mode) obtained by the second resonator (or second feeding port). In other words, the effect of the presence of hot and cold spots in a first mode field, i.e. the presence of hot and cold spots in the cavity, may be eliminated, or at least reduced, by the heating pattern of a second mode field thanks to an adequate configuration of the feeding ports (resonators).

In the present invention, as each of the feeding structures is connected to a microwave energy source, simultaneous feeding of microwaves at different frequencies is possible. However, depending on the application, e.g. for a specific type of load or a specific cooking program (or function), it is also possible to operate the microwaves sources such that feeding of the microwaves into the cavity switches between the two feeding ports. Such flexibility in feeding microwaves into the cavity allows for a controlled regulation accounting for e.g. change in the load (change in geometry, weight or state) during heating.

In order to implement such type of regulation, the microwave heating device 500 may further comprise a control unit 580 connected to the microwave sources 510 and 510' of the microwave heating device for controlling these sources, such as, e.g., their respective output powers. The control unit 580 may obtain information about the load and conditions in the cavity, by means of sensors (not shown) arranged in the cavity and connected to the control unit 580. The control unit 580 may further be configured to control, during an operation cycle, the frequency of operation of the sources and their respective time of operation during the cycle.

While specific embodiments have been described, the skilled person will understand that various modifications and alterations are conceivable within the scope as defined in the appended claims.

For example, although a cavity having a rectangular cross-section has been described in the application, it is also envisaged to implement the present invention in a cavity having a geometry describable in any orthogonal curve-linear coordinate system, e.g. a cavity having circular cross-section.

Further, although a cavity comprising only two feeding structures has been described to illustrate the reduction of crosstalk, a cavity comprising more than two feeding ports can be envisaged.

We claim:

1. A microwave heating device comprising:

a cavity arranged to receive a load to be heated; and a feeding structure for feeding microwaves in the cavity, the feeding structure comprising:

a transmission line for transmitting microwave energy generated by a microwave source; and a resonator arranged at a junction between the transmission line and the cavity for operating as a feeding port of the cavity, wherein a dielectric constant of material constituting an interior of the resonator and dimensions of the resonator are selected such that a resonance condition is established in the resonator for the microwave energy generated by the microwave source and impedance matching is established between the transmission line, the resonator and the cavity, wherein the dielectric constant of the material constituting the interior of the resonator is greater than that of material constituting an interior of the transmission line and wherein a cross-sectional dimension of the resonator is selected so as to be smaller than that of the transmission line.

2. The microwave heating device according to claim 1, wherein the material is a ceramic.

3. The microwave heating device according to claim 1, wherein the dielectric constant is in the range of 3-150.

4. The microwave heating device according to claim 1, further comprising a tuning element arranged in the transmission line or in the cavity, adjacent to the resonator, for local impedance adjustment.

5. The microwave heating device according to claim 1, wherein the microwave source is a solid state microwave generator.

6. The microwave heating device according to claim 1, wherein the transmission line is one of a waveguide, a coaxial cable or a strip line.

7. The microwave heating device according to claim 1, wherein the resonator is an elongated piece of dielectric material having a common cross-sectional shape with the transmission line.

8. A microwave heating device comprising:

a cavity arranged to receive a load to be heated; and a feeding structure for feeding microwaves in the cavity, the feeding structure comprising:

a transmission line for transmitting microwave energy generated by a microwave source; and a resonator arranged at a junction between the transmission line and the cavity for operating as a feeding port of the cavity, wherein a dielectric constant of material constituting an interior of the resonator and dimensions of the resonator are selected such that a resonance condition is established in the resonator for the microwave energy generated by the microwave source and impedance matching is established between the transmission line, the resonator and the cavity, wherein the resonator is coated with a metal.

9. The microwave heating device according to claim 8, wherein the dielectric constant of material constituting the interior of the resonator is greater than that of material constituting an interior of the transmission line and wherein a cross-sectional dimension of the resonator is selected so as to be smaller than that of the transmission line.

10. The microwave heating device according to claim 8, wherein the dielectric constant is in the range of 3-150.

11. The microwave heating device according to claim 10, wherein the dielectric constant is higher than 10.

12. A microwave heating device comprising:

a cavity arranged to receive a load to be heated; and a feeding structure for feeding microwaves in the cavity, the feeding structure comprising:

a transmission line for transmitting microwave energy generated by a microwave source; and a resonator arranged at a junction between the transmission line and the cavity for operating as a feeding port of the cavity, wherein a dielectric constant of material constituting an interior of the resonator and dimensions of the resonator are selected such that a resonance condition is established in the resonator for the microwave energy generated by the microwave source and impedance matching is established between the transmission line, the resonator and the cavity; and at least one additional feeding structure comprising:

an additional transmission line for transmitting microwave radiation generated by an additional microwave source; and an additional resonator arranged at a junction between the additional transmission line and the cavity for operating as an additional feeding port of the cavity, wherein a dielectric constant of material constituting an interior of the additional resonator and dimensions of the additional resonator are selected such that a resonance condition is established in the additional resonator for the microwave radiation generated by the additional microwave source and impedance matching is established between the additional transmission line, the additional resonator and the cavity.

13. The microwave heating device according to claim 12, wherein the microwave source and the additional microwave source are respectively operated at different frequencies.

14. The microwave heating device according to claim 12, comprising two feeding ports orthogonally arranged at walls of the cavity.

15. The microwave heating device according to claim 12, wherein the cavity is part of a microwave oven and adapted to receive a food item to be heated.

16. The microwave heating device according to claim 3, wherein the dielectric constant is higher than 10.

17. The microwave heating device according to claim 12, wherein the dielectric constant of the material constituting the interior of the resonator is greater than that of material constituting an interior of the transmission line and wherein a cross-sectional dimension of the resonator is selected so as to be smaller than that of the transmission line.

18. The microwave heating device according to claim 12, wherein the dielectric constant is in the range of 3-150.

19. The microwave heating device according to claim 18, wherein the dielectric constant is higher than 10.

20. The microwave heating device according to claim 12, wherein the resonator is coated with a metal.

* * * * *